US010927795B2

(12) United States Patent
Matsunaga et al.

(10) Patent No.: US 10,927,795 B2
(45) Date of Patent: Feb. 23, 2021

(54) FUEL EVAPORATIVE GAS EMISSION SUPPRESSING DEVICE

(71) Applicant: MITSUBISHI JIDOSHA KOGYO KABUSHIKI KAISHA, Tokyo (JP)

(72) Inventors: Hideo Matsunaga, Tokyo (JP); Kyosuke Uematsu, Tokyo (JP); Katsuhiro Furuta, Tokyo (JP)

(73) Assignee: MITSUBISHI JIDOSHA KOGYO KABUSHIKI KAISH, Tokyo (JP)

( * ) Notice: Subject to any disclaimer, the term of this patent is extended or adjusted under 35 U.S.C. 154(b) by 0 days.

(21) Appl. No.: 16/638,871

(22) PCT Filed: Feb. 26, 2018

(86) PCT No.: PCT/JP2018/006990
§ 371 (c)(1),
(2) Date: Feb. 13, 2020

(87) PCT Pub. No.: WO2019/053918
PCT Pub. Date: Mar. 21, 2019

(65) Prior Publication Data

US 2020/0191097 A1 Jun. 18, 2020

(30) Foreign Application Priority Data

Sep. 15, 2017 (JP) ..... JP2017-178229

(51) Int. Cl.
*F02M 25/08* (2006.01)
*F02D 41/22* (2006.01)

(52) U.S. Cl.
CPC .... *F02M 25/0809* (2013.01); *F02M 25/0836* (2013.01); *F02D 2041/225* (2013.01);
(Continued)

(58) Field of Classification Search
CPC ..... F02M 25/0809; F02M 25/0836; F02M 25/0854; F02M 25/089; F02M 25/0872;
(Continued)

(56) References Cited

U.S. PATENT DOCUMENTS 6,220,229 B1 * 4/2001 Kawamura ..... F02M 25/0809 123/520
6,276,344 B1 * 8/2001 Isobe ..... F02M 25/0809 123/519
(Continued)

FOREIGN PATENT DOCUMENTS

JP 2004-92510 A 3/2004
JP 2005-117599 A 4/2005
(Continued)

OTHER PUBLICATIONS

International Prelimimary Report on Patentability, dated Feb. 26, 2018, for International Application No. PCT/JP2018/006990.

*Primary Examiner* — Sizo B Vilakazi
(74) *Attorney, Agent, or Firm* — Birch, Stewart, Kolasch & Birch, LLP

(57) ABSTRACT

A controller has a leak determiner determining the presence or absence of an evaporative gas leak in a fuel evaporative gas emission suppressing device, based on a first pressure which is the pressure of a canister when a first predetermined period has elapsed in a state where a first opening/closing section and a second opening/closing section are closed, a third opening/closing section is opened, a fourth opening/closing section is closed, and a pressure generating section is operated; and a second pressure which is the pressure within the canister when, after a lapse of the first predetermined period, a second predetermined period has elapsed in a state where the third opening/closing section is closed.

7 Claims, 5 Drawing Sheets

(52) U.S. Cl.
CPC . *F02D 2200/0602* (2013.01); *F02M 25/0854* (2013.01); *F02M 2025/0845* (2013.01)

(58) Field of Classification Search
CPC ..... F02M 25/08; F02D 2041/225; F02D 2200/0602; F02D 2041/224
USPC ..... 123/518, 519, 520, 521
See application file for complete search history.

(56) References Cited

U.S. PATENT DOCUMENTS

| | | | | |
|---|---|---|---|---|
| 2005/0139197 | A1* | 6/2005 | Ohhashi | F02D 41/266 123/520 |
| 2010/0288021 | A1* | 11/2010 | Makino | F02M 25/0836 73/40.7 |
| 2012/0186333 | A1* | 7/2012 | Nishimura | G01M 3/3263 73/40.5 R |
| 2013/0096757 | A1* | 4/2013 | Fukui | B60W 20/50 701/22 |
| 2014/0174411 | A1* | 6/2014 | Matsunaga | F02M 25/0809 123/520 |
| 2015/0198123 | A1* | 7/2015 | Pearce | F02M 25/0809 123/520 |
| 2018/0171938 | A1* | 6/2018 | Watanabe | F02D 41/0037 |
| 2018/0274491 | A1* | 9/2018 | Uematsu | F02D 19/027 |

FOREIGN PATENT DOCUMENTS

| | | | |
|---|---|---|---|
| JP | 3849584 | B2 | 11/2006 |
| JP | 2015-96711 | A | 5/2015 |
| JP | 2015-117599 | A | 6/2015 |
| WO | WO 2016/207964 | A1 | 12/2016 |

* cited by examiner (a)

(b)

FUEL EVAPORATIVE GAS EMISSION SUPPRESSING DEVICE

TECHNICAL FIELD

This disclosure relates to a fuel evaporative gas emission suppressing device which introduces a fuel evaporative gas within a fuel tank into an air intake system of an engine to suppress its emission into the atmosphere. The disclosure relates, in particular, to a technology for detecting a fuel evaporative gas leak.

BACKGROUND ART

A fuel evaporative gas generated within a fuel tank presents a cause of air pollution. Thus, a vehicle loaded with an engine generally has a fuel evaporative gas treating device installed therein for suppressing the emission of the fuel evaporative gas into the atmosphere. The fuel evaporative gas treating device is configured, for example, to connect the fuel tank with an air intake system of the engine by a purge pipeline equipped with a canister, allow a fuel evaporative gas generated in the fuel tank to be once adsorbed to activated carbon within the canister, and introduce the activated carbon-adsorbed fuel into the air intake system of the engine in accordance with the negative pressure of intake air in the engine, thereby burning the fuel together with fresh air.

In recent years, vehicles provided with a traveling motor along with an engine, for example, a plug-in hybrid electric vehicle (PHEV) and a hybrid electric vehicle (HEV), have found practical use. In such a vehicle with a traveling motor, a period during which the engine is stopped, namely, a period in which no fuel can be introduced from the canister into the air intake system of the engine, may last for a relatively long time.

Hence, a so-called closed fuel evaporative gas emission suppressing device, a device having a sealing valve provided between the fuel tank and the canister for bringing the sealing valve to a closed state during stoppage of the engine, is under development. Among such closed fuel evaporative gas emission suppressing devices is one designed, for example, to provide an opening/closing valve near the inlet of the canister so that when the opening/closing valve is closed, a fuel evaporative gas is not introduced into the canister, but directly introduced into the air intake system of the engine.

In the above-mentioned fuel evaporative gas emission suppressing device, leakage of a fuel evaporative gas due to a certain trouble directly leads to air pollution. In the United States, etc., therefore, it is legally obligated to detect a fuel evaporative gas leak. Under the legal regulations of the United States, in particular, if a failure self-diagnosis (OBD: On-Board Diagnosis) for detecting such a fuel evaporative gas leak is made and the leak is detected, it is obligated to inform the driver, for example, by lighting a warning lamp. Needless to say, in a closed fuel evaporative gas emission suppressing device as well, it is required to perform leak detection similarly.

To fulfill such a requirement, a device is available, for example, in which with a canister space including a canister and a purge passage being closed, the internal pressure of the canister space is changed and, based on a change in the internal pressure of the canister space on this occasion, leakage diagnosis (detection of whether or not there is a leak) of the canister space is made (see Patent Document 1).

PRIOR ART DOCUMENTS

Patent Documents

Patent Document 1: Japanese Patent No. 3849584

With the device described in Patent Document 1, it is possible to determine the presence or absence of a leak in the canister space, with the fuel tank being cut off from the canister. The device, however, poses the problem that a fuel evaporative gas leak in a place other than the fuel tank, that is, in the canister space, can be detected, but the location of leakage in the canister space is difficult to pinpoint.

SUMMARY

An aspect of the present invention has been accomplished in the light of the above-described circumstances. It is an object of an aspect of the invention to provide a fuel evaporative gas emission suppressing device which can determine the presence or absence of a fuel evaporative gas leak and which makes it easy to pinpoint the location of the leak.

An aspect of the present invention resides in a fuel evaporative gas emission suppressing device comprising: a first communication path for bringing an intake air passage of an engine of a vehicle and a canister into communication; a second communication path branching off from a bifurcation provided in the first communication path, and communicating with a fuel tank; a third communication path for bringing the canister and outside air into communication; a first opening/closing section provided in the first communication path between the intake air passage and the bifurcation for opening up and cutting off the communication to the intake air passage; a second opening/closing section provided in the second communication path for opening up and cutting off the communication to the fuel tank; a third opening/closing section provided in the first communication path between the bifurcation and the canister for opening up and cutting off the communication to the canister; a fourth opening/closing section provided in the third communication path for opening up and cutting off the communication to the outside air; a pressure generating section disposed in the third communication path for generating a pressure in the canister; a canister pressure detector detecting the pressure of the canister; and a controller controlling opening and closing of the first opening/closing section, the second opening/closing section, the third opening/closing section, and the fourth opening/closing section, wherein the controller has a leak determiner determining presence or absence of a fuel evaporative gas leak in the fuel evaporative gas emission suppressing device, based on a first pressure which is the pressure of the canister when a first predetermined period has elapsed in a state where the first opening/closing section and the second opening/closing section are closed, the third opening/closing section is opened, the fourth opening/closing section is closed, and the pressure generating section is operated; and a second pressure which is the pressure within the canister when, after a lapse of the first predetermined period, a second predetermined period has elapsed in a state where the third opening/closing section is closed.

According to the aspect of the present invention described above, the presence or absence of a fuel evaporative gas leak in the fuel evaporative gas emission suppressing device can be determined properly, and the location of the leak is easy to pinpoint.

MODE FOR CARRYING OUT THE INVENTION

An embodiment of the present invention will be described in detail below by reference to the accompanying drawings.

Figure 1:
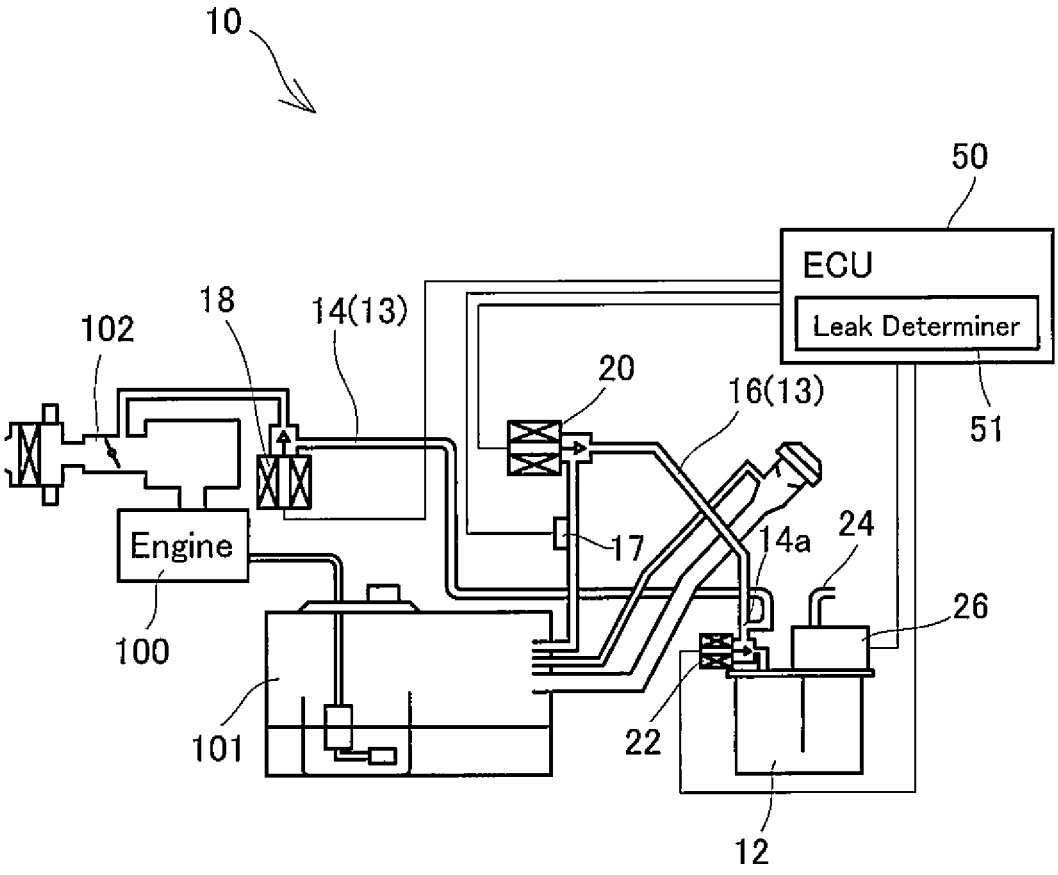
FIG. 1 is a view showing the schematic configuration of a fuel evaporative gas emission suppressing device according to an embodiment of the present invention.

As shown in FIG. 1, a fuel evaporative gas emission suppressing device 10 according to the present embodiment is a device which is loaded on a vehicle of an automobile or the like for suppressing the emission, into the atmosphere, of a fuel evaporative gas (vapor) generated within a fuel tank 101 for storing fuel to be supplied to an engine 100.

The fuel evaporative gas emission suppressing device 10 is equipped with a canister 12 having activated carbon sealed therein. The canister 12, the fuel tank 101, and an intake air passage 102 of the engine 100 are connected together by connecting piping 13.

In detail, the connecting piping 13 includes purge piping (first communication path) 14 for bringing the intake air passage 102 of the engine 100 and the canister 12 into communication, vapor piping (second communication path) 16 branching off from a bifurcation 14*a* provided in the purge piping 14 and communicating with the fuel tank 101, and vent piping (third communication path) 24 for bringing the canister 12 and the atmosphere into communication.

The canister 12 communicates with the intake air passage 102 of the engine 100 via the purge piping (first communication path) 14. The fuel tank 101 communicates with the bifurcation 14*a* of the purge piping 14 via the vapor piping (second communication path) 16. The vapor piping 16 is provided with a tank pressure sensor (tank pressure detector) 17 for detecting the pressure inside the fuel tank 101.

The purge piping 14 is provided with a purge valve (first opening/closing section) 18 for opening and closing the flow of a fuel evaporative gas to the intake air passage 102 (communication between the intake air passage 102 and the canister 12). The open and closed states of the purge valve 18 are switched as appropriate, whereby the state of supply of fuel (fuel evaporative gas) adsorbed by the canister 12 to the intake air passage 102 is controlled. The purge valve 18 is driven, for example, by an electromagnetic solenoid. The purge valve 18 is a so-called normally closed type electromagnetic valve which is closed when the electromagnetic solenoid is not energized, but is opened when the electromagnetic solenoid is energized.

The vapor piping 16, namely, its portion branching off from the purge piping 14 and located beside the fuel tank 101 with respect to the bifurcation 14*a*, is provided with a sealing valve (second opening/closing section) 20 which becomes open and closed for sealing the fuel tank 101. Furthermore, a portion of the purge piping 14 beside the canister 12 with respect to the bifurcation 14*a* is provided with a bypass valve (third opening/closing section) 22. The sealing valve 20 is a so-called normally closed type electromagnetic valve like the purge valve 18, while the bypass valve 22 is a so-called normally open type electromagnetic valve unlike the purge valve 18.

The vent piping (third communication path) 24 is connected to the canister 12, and the canister 12 communicates with the outside via the vent piping 24. Halfway through the vent piping 24 is provided an evaporative leak check module (ELCM) 26 for detecting a leak of the fuel evaporative gas from the fuel tank 101, the canister 12, and the connecting piping 13 including the purge piping 14 and the vapor piping 16 linked to these components.

Figure 2:
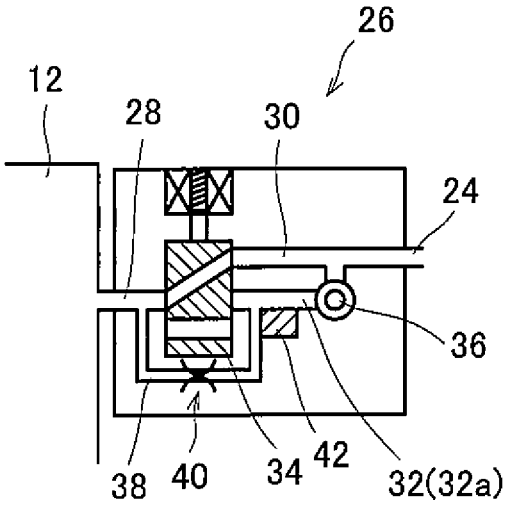
FIGS. 2(*a*), 2(*b*) are views showing the schematic configuration of an evaporative leak check module in accordance with an embodiment.
Figure 2:
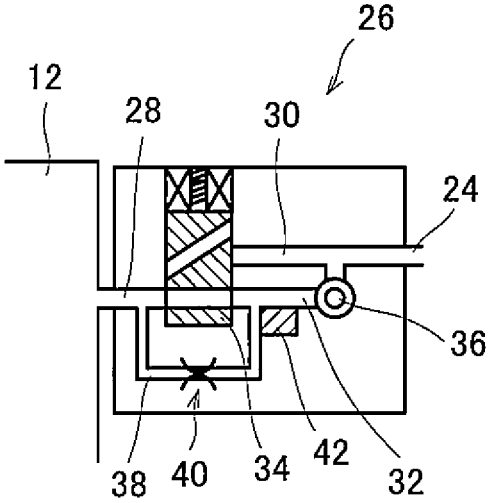

The ELCM 26, as shown in FIGS. 2(*a*), 2(*b*), is equipped with a first flow path 28 communicating with the canister 12, a second flow path 30 open to the atmosphere via the vent piping 24, and a third flow path 32 connected halfway between the first flow path 28 and the second flow path 30. A switching valve (fourth opening/closing section) 34 is provided between the first flow path 28 and the second flow path 30/third flow path 32.

The connection between the first flow path 28 and the second flow path 30 or the third flow path 32 is adapted to be switchable by the switching valve 34. The switching valve 34, for example, allows the first flow path 28 and the second flow path 30 to communicate in a state where the electromagnetic solenoid is not energized, but allows the first flow path 28 and the third flow path 32 to communicate in a state where the electromagnetic solenoid is energized.

The third flow path 32 is provided with a negative pressure pump 36 which generates a negative pressure within the canister 12. The first flow path 28 and the third flow path 32 have a fourth flow path 38 provided astride the switching valve 34. The fourth flow path 38 is provided with a reference orifice 40, for example, with a diameter of 0.45 mm, and a canister pressure sensor (canister pressure detector) 42 for detecting the pressure inside the canister 12 is provided beside the second flow path 30 with respect to the reference orifice 40. Hereinafter, the pressure detected by the canister pressure sensor 42 is referred to simply as "canister pressure".

The above-mentioned negative pressure pump (pressure generating section) 36 and switching valve 34 constituting the ELCM 26, and the purge valve 18, sealing valve 20, and bypass valve 22 mentioned above are controlled based on control signals from an ECU (controller) 50. The ECU (controller) 50 may be provided independently for each of the purge valve 18, sealing valve 20, and bypass valve 22.

The ECU 50 is equipped with a leak determiner 51. The leak determiner 51 executes the leak determination of a fuel evaporative gas in the canister 12 and the connecting piping 13. Concretely, while operating the negative pressure pump 36 to reduce the pressure inside the canister 12, the ECU 50 switches the sealing valve 20 from a closed state to an open state and, based on a pressure change in the canister 12, determines the presence or absence of a leak in the canister 12 and the connecting piping 13, or determines where a leak is occurring. The canister 12, the target for leak determination, means the closed space of the canister 12 closed by the bypass valve 22. The connecting piping 13 for which leak determination is performed means the closed space of the communication paths (purge piping 14 and vapor piping 16) closed by the purge valve 18, sealing valve 20 and bypass valve 22.

If it is determined by the leak determiner 51 that there is a leak of a fuel evaporative gas, the driver is warned, for example, by lighting a warning lamp for leak indication which is provided near the driver's seat.

Figure 3:
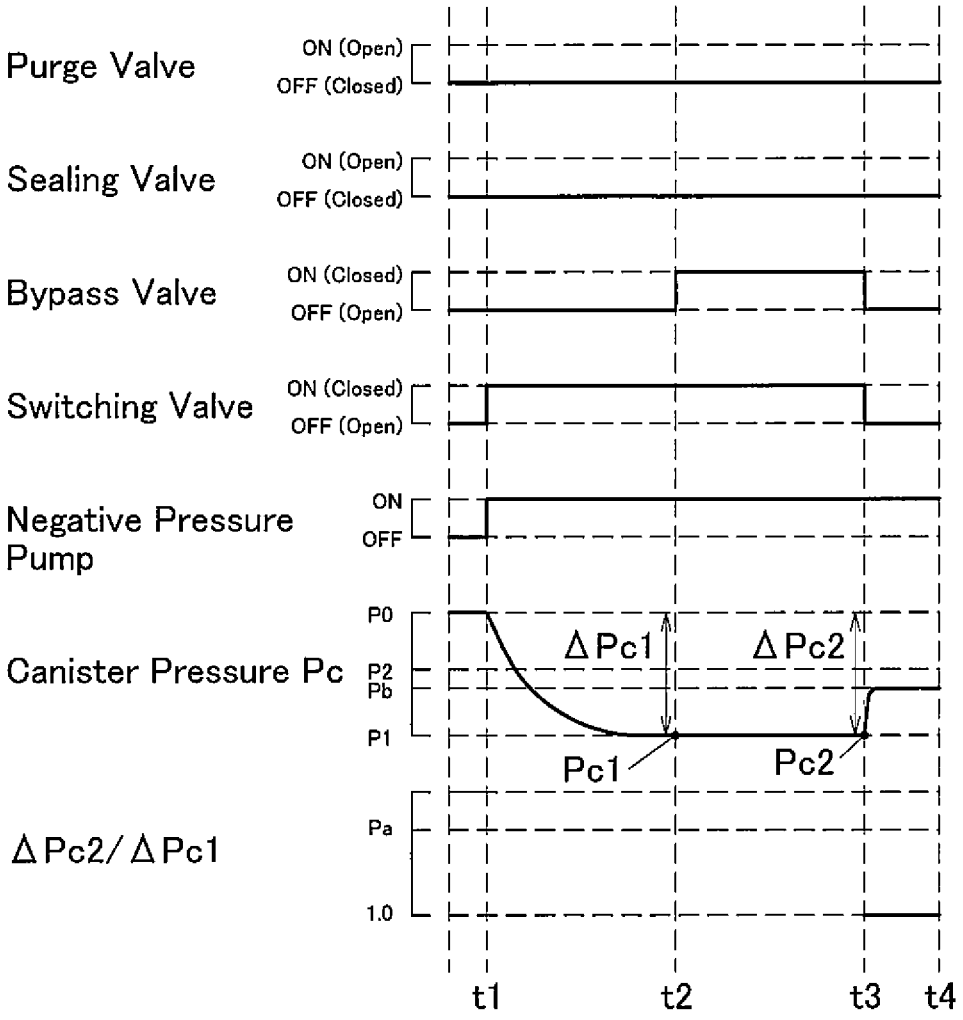
FIG. 3 is a timing chart showing the operating state of each valve and so on in leak determination in accordance with an embodiment.
Figure 4:
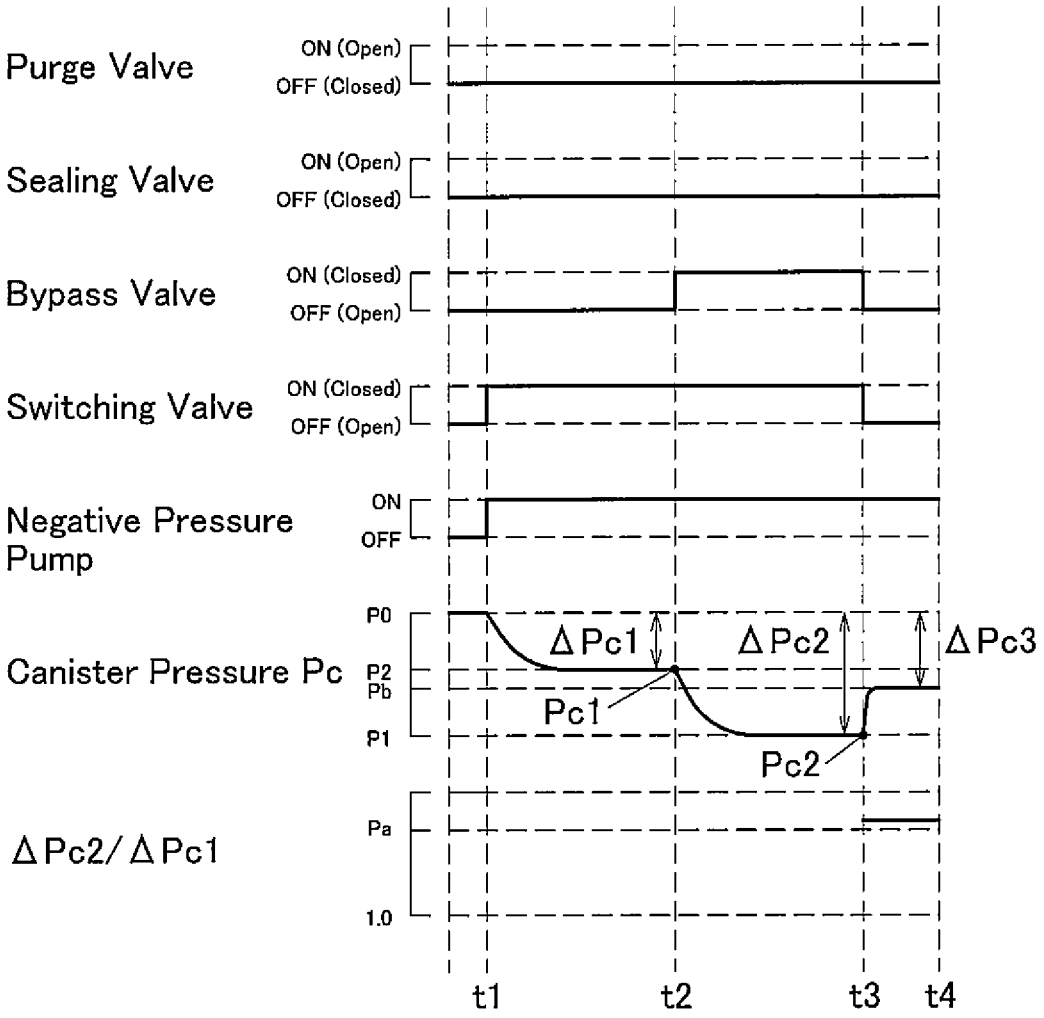
FIG. 4 is a timing chart showing the operating state of each valve and so on in leak determination in accordance with an embodiment.
Figure 5:
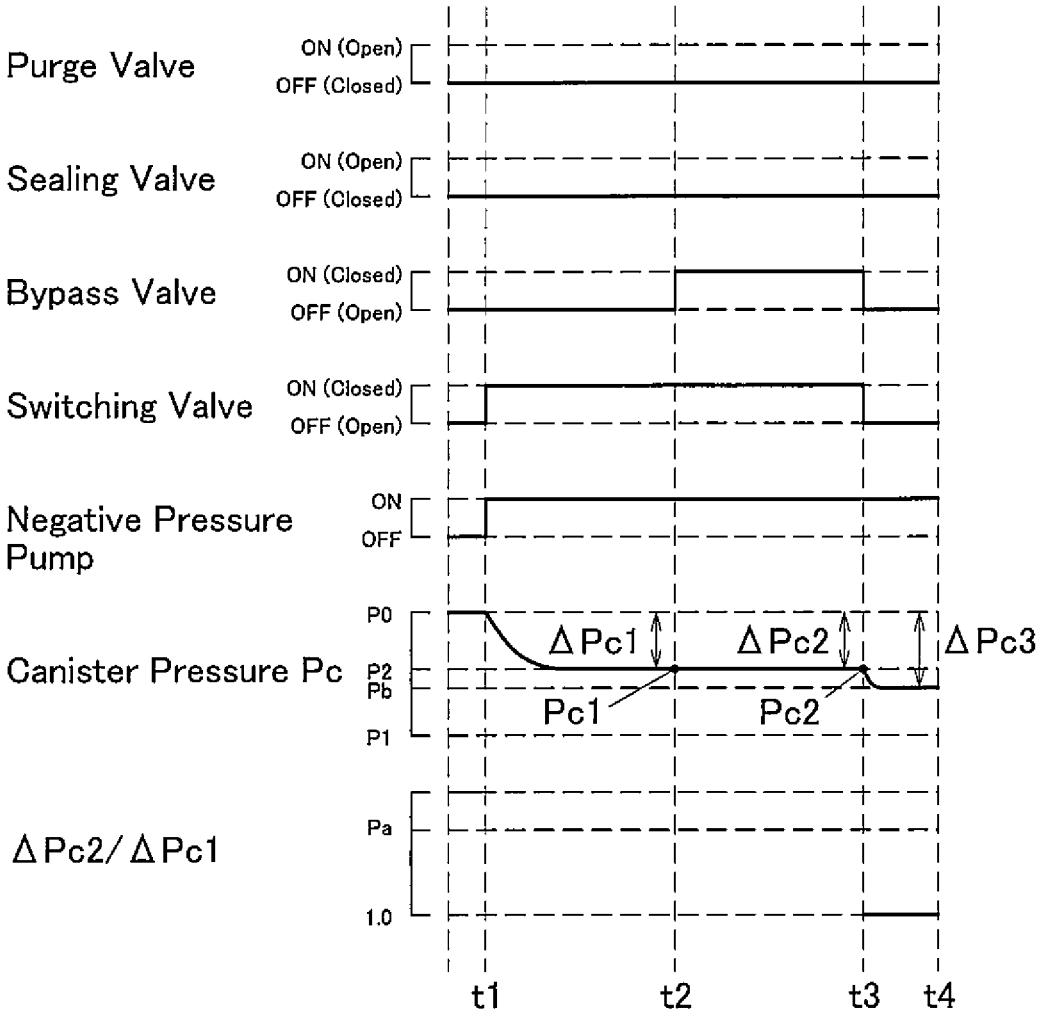
FIG. 5 is a timing chart showing the operating state of each valve and so on in leak determination in accordance with an embodiment.

The procedure for leak determination by the leak determiner 51 will be described below by reference to FIGS. 3 to 5. FIGS. 3 to 5 are timing charts showing chronologically the operating states of each valve and the negative pressure pump, canister pressure, etc. in leak determination.

When the leak determiner 51 starts leak determination, the pressure inside the canister 12 is first brought to an initial value (e.g., atmospheric pressure) P0, then at a time t1, the purge valve 18 and the sealing valve 20 are closed, the bypass valve 22 is opened, and the switching valve 34 is closed. In this state, the negative pressure pump 36 is actuated. Actually, the purge valve 18 and the sealing valve 20 are not operated, while the switching valve 34, a normally open type electromagnetic valve, is actuated to be switched from an open state to a closed state, and the negative pressure pump 36 is operated.

By this action, a negative pressure is generated within the canister 12 and the connecting piping 13 (in the space beside the canister 12 with respect to the purge valve 18 and the sealing valve 20). A change in the canister pressure $P_c$ is detected by the canister pressure sensor 42.

If, on this occasion, no leak hole leading to the outside exists in the canister 12 and the connecting piping 13 and there is no fuel evaporative gas leak, the pressure inside the canister 12 and the connecting piping 13 (canister pressure $P_c$ detected by the canister pressure sensor 42) decreases from the initial value (atmospheric pressure) P0 to a first value P1, the lowest value, as shown in FIG. 3. In short, a first pressure $P_c$1, the canister pressure $P_c$ at a time t2, has the first value P1.

If there is a leak hole in the canister 12 or the connecting piping 13, on the other hand, the canister pressure $P_c$ does not decrease to the first value P1, but as shown in FIGS. 4 and 5, decreases only to a second value P2 (>P1). In short, the first pressure $P_c$1, the canister pressure $P_c$ at the time t2, has the second value P2.

Then, at the time t2, the bypass valve 22 is switched from the open state to the closed state. That is, at a timing when after a lapse of a preset first predetermined period (t1-t2), the change (decrease) in the canister pressure $P_c$ settles, the bypass valve 22 is operated to be switched from the open state to the closed state. In this state, the operation of the negative pressure pump 36 is continued to a time t3 to reduce the pressure within the canister 12. A change in the canister pressure $P_c$ is detected by the canister pressure sensor 42.

If, on this occasion, there is no leak hole in the canister 12 and no leak of the fuel evaporative gas occurs, the pressure inside the canister 12 (canister pressure $P_c$) decreases to the first value P1. In short, a second pressure $P_c$2, the canister pressure $P_c$ at the time t3, has the first value P1.

If, at the time t2, the canister pressure $P_c$ (first pressure $P_c$1) reaches the first value P1, for example, the canister pressure $P_c$ is maintained at the first value P1 at a time later than the time t2, and the canister pressure $P_c$ detected at the time t3 (second pressure $P_c$2) is also held at the first value P1, as shown in FIG. 3. If the canister pressure $P_c$ at the time t2 (first pressure $P_c$1) takes the second value P2 (failing to reach the first value P1), on the other hand, the canister pressure $P_c$ decreases to the first value P1 at a time later than the time t2, as shown in FIG. 4. Therefore, the canister pressure $P_c$ detected at the time t3 (second pressure $P_c$2) takes the first value P1.

If there is no leak hole in the connecting piping 13, but there is a leak hole in the canister 12, then the canister pressure $P_c$ is maintained at the pressure existent at the point in time of the time t2. For example, if the canister pressure $P_c$ detected at the time t2 (first pressure $P_c$1) is of the second value P2, the canister pressure $P_c$ is maintained at the second value P2 at a time later than the time t2, as shown in FIG. 5. That is, the canister pressure $P_c$ detected at the time t3 (second pressure $P_c$2) also has the second value P2.

If a leak hole exists in each of the canister 12 and the connecting piping 13, the canister pressure $P_c$ does not lower to the first value P1, but changes stepwise, although this is not shown. If the canister pressure $P_c$ detected at the time t2 (first pressure $P_c$1) has the second value P2, for example, the canister pressure $P_c$ detected at the time t3 (second pressure $P_c$2) takes a third value which is higher than the first value P1 and lower than the second value P2.

Then, at the time t3, the operation of the bypass valve 22 and the switching valve 34 is stopped to switch their status from the closed state to the open state. That is, at a timing when a preset second predetermined period (t2-t3) has passed, and the change (decrease) in the canister pressure $P_c$ settles, the bypass valve 22 and the switching valve 34 are switched from the closed state to the open state.

Even in this state, the operation of the negative pressure pump 36 is continued. By so doing, the reference pressure $P_b$ of the canister pressure $P_c$ is detected. If, at the time t3, the bypass valve 22 and the switching valve 34 are switched from the closed state to the open state, for example, a negative pressure is generated only in a space 32*a* (see FIG. 2(*a*)) between the negative pressure pump 36 on the third flow path 32 and the reference orifice 40. Then, at a timing when changes in the canister pressure $P_c$ settle (e.g., at a time t4), the pressure in the space 32*a* is detected as the reference pressure $P_b$ of the canister pressure $P_c$.

If, on this occasion, the canister pressure $P_c$ detected at the time t3 (second pressure $P_c$2) is lower than the reference pressure $P_b$, the canister pressure $P_c$ rises at a time later than the time t3 (see FIG. 3). In a case where no leak hole exists in the canister 12, or the diameter (opening area) of the leak hole, if any, is smaller than the reference orifice 40, the canister pressure $P_c$ (second pressure $P_c$2) is lower than the reference pressure $P_b$ at the time t3.

If the canister pressure $P_c$ detected at the time t3 (second pressure $P_c$2) is higher than the reference pressure $P_b$ (see, for example, FIG. 5), on the other hand, the canister pressure $P_c$ further decreases at a time later than the time t3. In a case where there is a leak hole in the canister 12, and the diameter of the leak hole is larger than the reference orifice 40, the canister pressure $P_c$ (second pressure $P_c$2) is higher than the reference pressure $P_b$ at the point in time of the time t3.

The leak determiner 51 determines the presence or absence of a leak in the canister 12 and the connecting piping 13 based on the canister pressure $P_c$ changing as above. In the present embodiment, the leak determiner 51 determines the presence or absence of a leak in the connecting piping 13 at the timing of the time t3, and determines the presence or absence of a leak in the canister 12 at the timing of the time t4.

Concretely, the leak determiner 51 determines the presence or absence of a leak of a fuel evaporative gas based on the first pressure $P_c$1 which is the canister pressure $P_c$ at the time t2, and the second pressure $P_c$2 which is the canister pressure $P_c$ at the time t3.

In the present embodiment, the leak determiner 51 first determines whether or not there is a leak hole in the connecting piping 13, based on a first pressure change amount $\Delta P_c$1 which is the difference (pressure decrease amount) between the initial pressure (atmospheric pressure) P0 and the first pressure $P_c$1 of the canister pressure $P_c$, and a second pressure change amount $\Delta P_c$2 which is the difference (pressure decrease amount) between the initial pressure P0 and the second pressure $P_c$2 of the canister pressure $P_c$.

Depending on whether or not there is a leak hole in the connecting piping 13, as mentioned above, the first pressure change amount $\Delta P_c$1 and the second pressure change amount $\Delta P_c$2, which are the decrease amounts of the canister pressure $P_c$ in the period (time t1-time t3), undergo changes. Thus, the leak determiner 51 determines whether or not there is a leak hole in the connecting piping 13, based on the first pressure change amount $\Delta P_c$1 and the second pressure change amount $\Delta P_c$2 which are the decrease amounts of the canister pressure $P_c$.

In detail, the leak determiner 51 determines that a leak hole is present in the connecting piping 13, if the ratio ($\Delta P_c$2/$\Delta P_c$1) of the second pressure change amount $\Delta P_c$2 to the first pressure change amount $\Delta P_c$1 is equal to or higher than a preset determination threshold value $P_a$ (>1). The driver is informed of this fact for warning.

If, for example, the canister pressure $P_c$ at the time t2 (the first pressure $P_c$1) has the second value P2, then the canister pressure $P_c$ decreases, and the canister pressure $P_c$ at the time t3 (the second pressure $P_c$2) comes to the first value P1, as shown in FIG. 4, the lead determiner 51 determines that a leak hole exists in the connecting piping 13.

If the ratio ($\Delta P_c$2/$\Delta P_c$1) of the second pressure change amount $\Delta P_c$2 to the first pressure change amount $\Delta P_c$1 is lower than the preset determination threshold value $P_a$ (>1), on the other hand, the leak determiner 51 determines that a fuel evaporative gas leak is absent (there is no leak hole) in the connecting piping (first to third communication paths) 13, and then determines the presence or absence of a fuel evaporative gas leak in the canister 12.

Situations where the ratio ($\Delta P_c$2/$\Delta P_c$1) of the second pressure change amount $\Delta P_c$2 to the first pressure change amount $\Delta P_c$1 is lower than the determination threshold value $P_a$ include a case in which the canister pressure $P_c$ is maintained at the first value P1 during the period (t2-t3) as shown in FIG. 4, and another case in which the canister pressure $P_c$ is maintained at the second value P2 as shown in FIG. 5. Thus, the leak determiner 51 then determines the presence or absence of a fuel evaporative gas leak in the canister 12.

In the present embodiment, the leak determiner 51 determines the presence or absence of a leak in the canister 12, based on the reference pressure $P_b$ of the canister pressure $P_c$. Concretely, if the second pressure change amount $\Delta P_c$2 detected at the time t3 is equal to or smaller than a third pressure change amount $\Delta P_c$3 which is the difference between the initial pressure (atmospheric pressure) P0 and the reference pressure $P_b$ of the canister 12, the leak determiner 51 determines that a leak in the canister 12 is present, and warns the driver of this fact. In other words, if the reference pressure $P_b$ is equal to or smaller than the canister pressure $P_c$ at the time t3 (second pressure $P_c$2), the leak determiner 51 determines that a leak in the canister 12 is present, and warns the driver of this fact.

If the second pressure change amount $\Delta P_c$2 detected at the time t3 is larger than the third pressure change amount $\Delta P_c$3 which is the difference between the initial pressure (atmospheric pressure) P0 and the reference pressure $P_b$ of the canister 12, on the other hand, the leak determiner 51 determines that there is no leak in the canister 12. In other words, if the reference pressure $P_b$ is higher than the canister pressure $P_c$ at the time t3 (second pressure $P_c$2), the leak determiner 51 determines that there is no leak in the canister 12. That is, if no leak hole exists in the canister 12, or the diameter of the leak hole, if any, is smaller than the reference orifice 40, the leak determiner 51 determines that there is no leak in the canister 12.

With the aspect of the present invention, as described above, the leak determiner 51 executes leak determination to determine the presence or absence of a fuel evaporative gas leak in the canister 12 and the connecting piping 13. This feature makes it possible to determine appropriately the presence or absence of a fuel evaporative gas leak, and to specify the location of leak to some extent.

The one embodiment of the present invention has been described above, but the aspect of the invention is not limited to the foregoing embodiment. The invention can be changed or modified, as appropriate, without departing from the spirit of the invention.

In the above-described embodiment, for example, the configuration having the negative pressure pump for generating a negative pressure in the canister is illustrated as the pressure generating section. However, a booster pump for pressurizing (generating a positive pressure in) the canister may be provided as the pressure generating section. That is, leak determination can be executed, with the canister pressure being brought to a positive pressure.

In the above embodiment, moreover, the presence or absence of a leak is determined based on the ratio of the second pressure change amount to the first pressure change amount. The leak determination according to the aspect of the present invention, however, may be performed based on the first pressure and the second pressure serving as the canister pressure. For example, leak determination can be made based on a deviation between the first pressure change amount and the second pressure change amount.

EXPLANATIONS OF LETTERS OR NUMERALS

10 Fuel evaporative gas emission suppressing device
12 Canister
13 Connecting piping
14 Purge piping (first communication path)
14*a* Bifurcation
16 Vapor piping (second communication path)
17 Tank pressure sensor (tank pressure detecting section)
18 Purge valve (first opening/closing section)
20 Sealing valve (second opening/closing section)
22 Bypass valve (third opening/closing section)
24 Vent piping (third communication path)
26 Evaporative leak check module (ELCM)
28 First flow path
30 Second flow path
32 Third flow path
32*a* Space
34 Switching valve (fourth opening/closing section)
36 Negative pressure pump (pressure generating section)
38 Fourth flow path
40 Reference orifice
42 Canister pressure sensor (canister pressure detecting section)
50 ECU (control unit)
51 Leak determiner (Leak determinating unit)

100 Engine
101 Fuel tank
102 Intake air passage

The invention claimed is:

1. A fuel evaporative gas emission suppressing device, comprising:

a first communication path for bringing an intake air passage of an engine of a vehicle and a canister into communication;

a second communication path branching off from a bifurcation provided in the first communication path, and communicating with a fuel tank;

a third communication path for bringing the canister and outside air into communication; a first opening/closing section provided in the first communication path between the intake air passage and the bifurcation for opening up and cutting off the communication to the intake air passage;

a second opening/closing section provided in the second communication path for opening up and cutting off communication to the fuel tank;

a third opening/closing section provided in the first communication path between the bifurcation and the canister for opening up and cutting off the communication to the canister;

a fourth opening/closing section provided in the third communication path for opening up and cutting off the communication to the outside air;

a pressure generating section disposed in the third communication path for generating a pressure in the canister;

a canister pressure detector detecting the pressure of the canister; and a controller configured to control opening and closing of the first opening/closing section, the second opening/closing section, the third opening/closing section, and the fourth opening/closing section, wherein the controller has a leak determiner that is configured to determine presence or absence of a fuel evaporative gas leak in the fuel evaporative gas emission suppressing device, by detecting a first pressure which is the pressure of the canister when a first predetermined period has elapsed in a state where the first opening/closing section and the second opening/closing section are closed, the third opening/closing section is opened, the fourth opening/closing section is closed, and the pressure generating section is operated; and a second pressure which is the pressure within the canister when, after a lapse of the first predetermined period, a second predetermined period has elapsed in a state where the third opening/closing section is closed, and then comparing a value based on the first pressure and a value based on the second pressure.

2. The fuel evaporative gas emission suppressing device according to claim 1, wherein the leak determiner determines the presence or absence of the fuel evaporative gas leak based on a first pressure change amount which is a difference between an initial pressure of the canister and the first pressure, and a second pressure change amount which is a difference between the initial pressure and the second pressure.

3. The fuel evaporative gas emission suppressing device according to claim 2, wherein the leak determiner determines that the fuel evaporative gas leak is present in a closed space of the communication paths closed by the first opening/closing section, the second opening/closing section, and the third opening/closing section, on condition that a ratio of the second pressure change amount to the first pressure change amount is equal to or higher than a preset determination threshold value.

4. The fuel evaporative gas emission suppressing device according to claim 3, wherein the leak determiner determines that the fuel evaporative gas leak is absent in the closed space of the communication paths, on condition that the ratio of the second pressure change amount to the first pressure change amount is lower than the determination threshold value, and the leak determiner further determines the presence or absence of the fuel evaporative gas leak based on a third pressure change amount which is a difference between the initial pressure and a reference pressure of the canister detected after detection of the second pressure.

5. The fuel evaporative gas emission suppressing device according to claim 4, wherein the leak determiner determines that the fuel evaporative gas leak is present in the canister, if the second pressure change amount is equal to or smaller than the third pressure change amount.

6. The fuel evaporative gas emission suppressing device according to claim 4, wherein the reference pressure is the pressure inside the canister in a state where the third opening/closing section and the fourth opening/closing section are opened after a lapse of the second predetermined period.

7. The fuel evaporative gas emission suppressing device according to claim 5, wherein the reference pressure is the pressure inside the canister in a state where the third opening/closing section and the fourth opening/closing section are opened after a lapse of the second predetermined period.

* * * * *